US005152113A

United States Patent [19]

Guddas

[11] Patent Number: 5,152,113

[45] Date of Patent: Oct. 6, 1992

[54] ROOM PARTITION

[76] Inventor: Jürgen Guddas, Contrescarpe 65, W-2800 Bremen 1, Fed. Rep. of Germany

[21] Appl. No.: 647,651

[22] Filed: Jan. 29, 1991

[30] Foreign Application Priority Data

Jan. 31, 1990 [DE] Fed. Rep. of Germany ..... 4002793

[51] Int. Cl.[5] ..... E04H 1/12; A47G 5/00

[52] U.S. Cl. ..... 52/238.1; 52/241; 52/243.1; 52/281; 160/135

[58] Field of Search ..... 52/238.1, 241, 243.1, 52/242, 281, 282; 160/135, 351, 40

[56] References Cited

U.S. PATENT DOCUMENTS

| | | | |
|---|---|---|---|
| 3,013,642 | 12/1961 | Hammitt et al. | 52/238.1 |
| 4,356,672 | 11/1982 | Beckman et al. | 52/238.1 X |
| 4,436,135 | 3/1984 | Ytter | 160/135 |
| 4,703,598 | 11/1987 | Wilson et al. | 52/238.1 |
| 4,854,096 | 8/1989 | Smolik | 52/241 |
| 4,884,375 | 12/1989 | Wendt | 52/241 X |
| 4,905,428 | 3/1990 | Sykes | 160/135 X |

FOREIGN PATENT DOCUMENTS

| | | | |
|---|---|---|---|
| 908384 | 8/1972 | Canada | 52/241 |
| 1156017 | 11/1983 | Canada | 52/241 |
| 1405403 | 5/1965 | France | 52/241 |
| 1452874 | 8/1966 | France | 52/241 |
| 2355966 | 1/1978 | France | 52/238.1 |

*Primary Examiner*—David A. Scherbel
*Assistant Examiner*—Kien Nguyen
*Attorney, Agent, or Firm*—Peter K. Kontler

[57] ABSTRACT

A composite partition with several rectangular sections each of which has a panel surrounded by a frame having top, bottom and lateral frame members with channels for the respective edges of the panel. The top frame members extend into an inverted U-shaped rail which is affixed to the ceiling, and the bottom frame members extend into a U-shaped rail which is affixed to the floor. One lateral panel of one of two neighboring sections is separated from the adjacent lateral frame member of the other neighboring section by a narrow clearance which receives interengaged separable male and female detent elements of two elongated strip-shaped coupling members at opposite sides of the partition. The outer portions of the coupling members are recessed into the adjacent sides of the lateral frame members.

11 Claims, 3 Drawing Sheets

ROOM PARTITION

BACKGROUND OF THE INVENTION

The invention relates to partitions in general, and more particularly to improvements in partitions which can be utilized with advantage to subdivide rooms in homes, office buildings and/or other types of dwellings. Still more particularly, the invention relates to improvements in partitions which are or can be assembled of plural sections or modules so that they can be used to divide smaller or larger rooms or to constitute full-sized or partial divisions for rooms.

It is already known to assemble a composite room partition of several sections or modules (hereinafter called sections) each of which includes a panel (e.g., a rectangular panel) and four frame members which are respectively adjacent the top edge, the bottom edge and the two lateral edges of the respective panel. The top frame members are receivable in a rail which is mounted on the ceiling, and the bottom frame members are receivable in a rail which is affixed to the floor. The four frame members of each section are assembled into a rigid rectangular frame which is affixed to the two rails, and the panels are thereupon introduced into the thus assembled and fixedly mounted frames. The means for retaining the panels in the respective frames often includes strip-shaped or analogous holding elements. A drawback of the just described conventional partitions is that they cannot be converted into smaller or larger partitions. Thus, it is necessary to use fresh sections or to modify the existing sections if an existing partition is to be replaced with or converted into a different partition. This contributes to the cost of replacement or conversion of existing partitions.

OBJECTS OF THE INVENTION

An object of the invention is to provide a novel and improved partition which is more versatile than heretofore known partitions.

Another object of the invention is to provide a composite partition which is constructed and assembled in such a way that each of its constituents can be reused, as often as desired, when an existing partition is to be converted into a larger or smaller partition or transported or transferred to a different locale of use.

A further object of the invention is to provide the partition with novel and improved means for coupling neighboring sections or modules to each other.

An additional object of the invention is to provide a partition wherein the neighboring sections can be coupled to and separated from each other without the need for special tools or any tools.

Still another object of the invention is to provide novel and improved sections or modules for use in the above outlined partition.

A further object of the invention is to provide a novel and improved frame and novel and improved frame members for use in the sections of the above outlined partition.

Another object of the invention is to provide an eye-pleasing partition wherein all parts which would be likely to detract from its appearance are automatically concealed when the sections of the partition are properly coupled to each other.

An additional object of the invention is to provide a partition which can be assembled, modified or taken apart with little loss in time and without necessitating reliance on skilled or even semiskilled persons.

A further object of the invention is to provide a partition which can be designed to accept parts of standard partitions, for example, to accept the panels of sections in conventional partitions.

SUMMARY OF THE INVENTION

The invention is embodied in a room partition which comprises at least two adjoining sections each including a panel having a top edge, a bottom edge and first and second lateral edges. Each section further comprises top and bottom frame members which respectively receive the top and bottom edges, and first and second lateral frame members which respectively receive the first and second lateral edges of the respective panel. If two adjoining sections are to be assembled into a coherent partition, the first lateral frame member of one of the two sections is located adjacent to the second lateral frame member of the other section so that such adjacent frame members define a clearance, and the partition further comprises means for separably coupling the adjacent frame members of the two sections to each other. The coupling means comprises at least one first coupling member overlying portions of the adjacent frame members at one side of the clearance, and at least one second coupling member which overlies the adjacent frame members at the other side of the clearance opposite the first coupling member. One of the coupling members has female detent means in the clearance and the other coupling member has male detent means engaging the female detent means.

Each coupling member can have a substantially T-shaped cross-sectional outline. The male detent means can include a web which extends into the clearance and has a bead or head which is received, particularly by snap action, in a complementary socket of the female detent means.

The adjacent frame members (i.e., the frame members which define the aforementioned clearance) are preferably provided with recesses at both sides of the clearance, and the coupling members can include outer portions in such recesses. The arrangement may be such that the outer portions of the coupling members at least substantially fill but do not extend from the respective recesses.

Each top frame member and each bottom frame member can have a substantially U-shaped cross-sectional outline to receive the respective edge between its legs.

The partition preferably further comprises a floor-mounted rail which locates the bottom frame members of the coupled sections in substantially horizontal positions, and a ceiling-mounted rail which locates the top frame members of the coupled sections in substantially horizontal positions. The rails can be provided with tracks for portions of the respective frame members so that such frame members can be caused to slide along the respective rails.

The top and bottom frame members can be provided with grooves or channels for the top and bottom edges of the respective panels. Analogously, the first and second lateral frame members of each section can have channels or grooves for the respective lateral edges of the corresponding panels. The ends of the top and bottom frame members can abut and are preferably affixed to the first and second lateral frame members of the respective sections, or vice versa.

Each first and each second lateral frame member can constitute an elongated hollow profiled body which has a polygonal outline.

The novel features which are considered as characteristic of the invention are set forth in particular in the appended claims. The improved partition itself, however, both as to its construction and the mode of assembling and dismantling the same, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
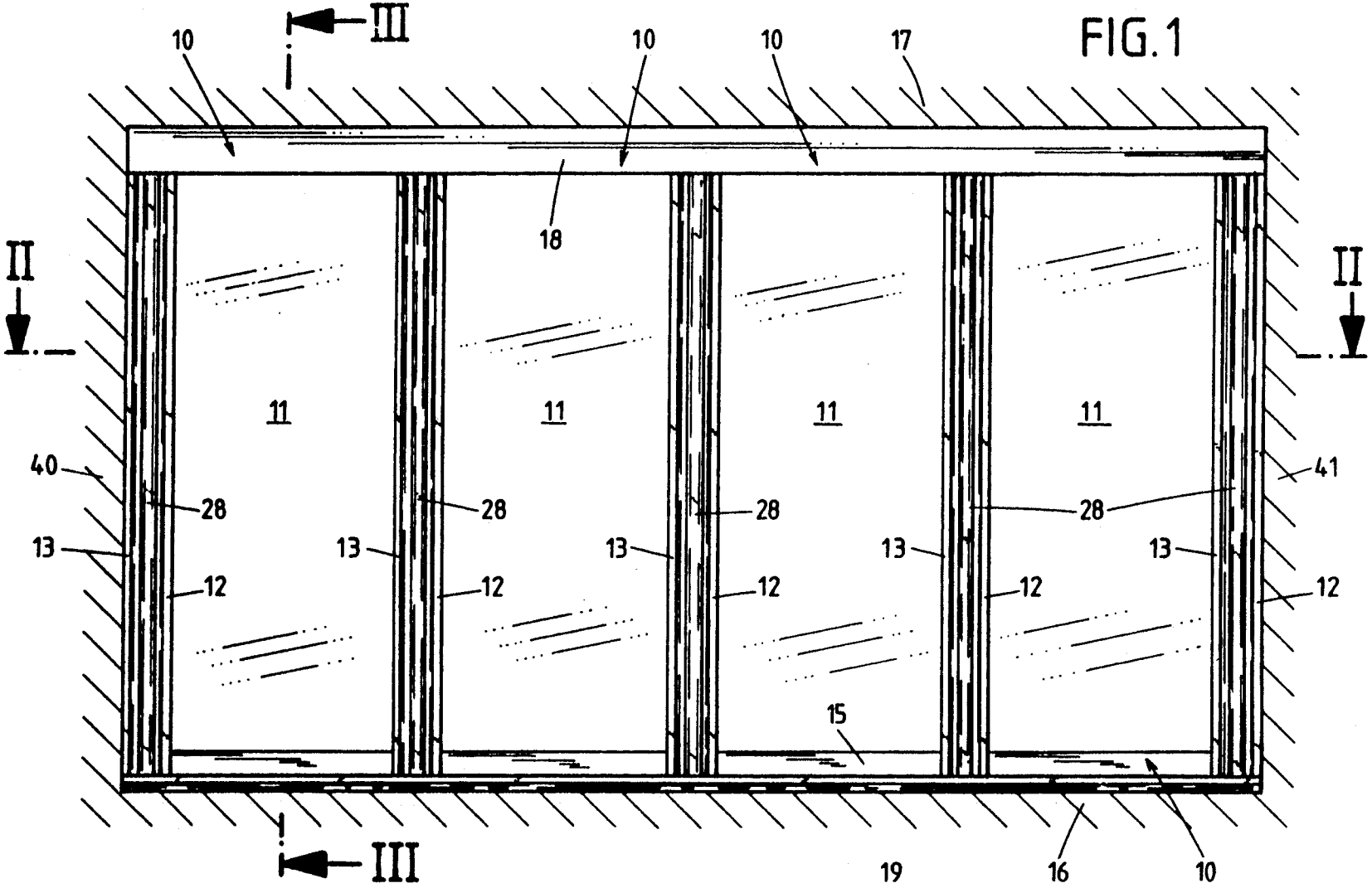
FIG. 1 is a schematic front elevational view of a room partition which comprises four rectangular sections and is constructed and assembled in accordance with a presently preferred embodiment of the invention.

The partition which is shown in the drawing comprises four identical coplanar sections or modules 10 which are assembled side-by-side to divide a room all the way between the ceiling 17, floor 16, a first upright sidewall 40, and a second upright sidewall 41. The number of sections can be reduced to two or three or increased to five or more.

Figure 2:
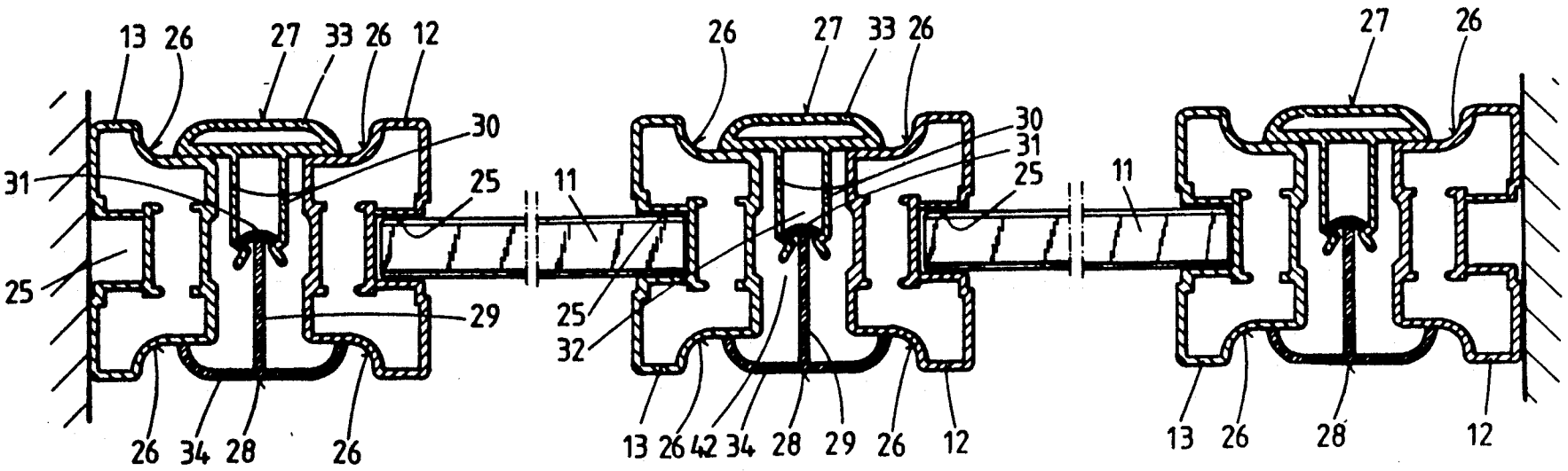
FIG. 2 is an enlarged fragmentary horizontal sectional view substantially as seen in the direction of arrows from the line II—II in FIG. 1.

Each section 10 comprises a rectangular panel or filler 11 having a top edge received in a channel or groove of a top frame member 14 (FIG. 3), a bottom edge received in a channel or groove of a bottom frame member 15 (FIG. 3), and two lateral edges which are received in vertical grooves (FIG. 3) of two lateral frame members 12, 13. The frame members 12 are shown in each of FIGS. 1 to 3, and the frame members 13 are shown in FIGS. 1 and 2. The frame members 12, 13, 14 and 15 of each section 10 are or can be assembled into a rigid rectangular frame which surrounds and receives the edges of the respective panel 11 before the thus assembled section is installed between a bottom rail 19 which is affixed to the floor 16 and a top rail 18 which is affixed to the ceiling 17. The ends of the horizontal frame members 14, 15 can abut the adjacent vertical sides of the lateral frame members 12, 13 or vice versa. The fastener means can comprise screws, bolts and nuts or the like, not specifically shown. Similar fasteners (shown but not referenced in FIG. 3) can be used to fixedly secure the bottom rail 19 to the floor 16 and to fixedly secure the top rail 18 to the ceiling 17.

Figure 3:
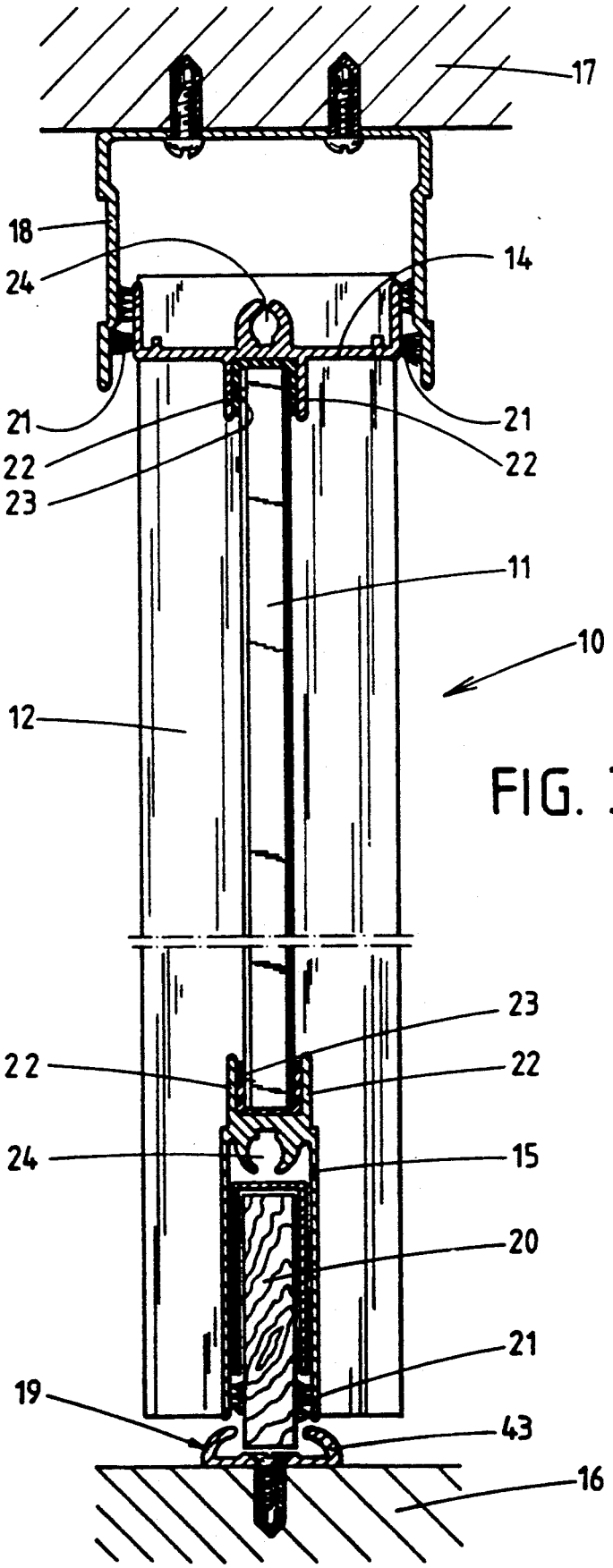
FIG. 3 is an enlarged fragmentary vertical sectional view substantially as seen in the direction of arrows from the line III—III in FIG. 1.

The top rail 18 has an inverted U-shaped cross-sectional outline and has a channel or track with a depth sufficient to provide room for lifting of a section 10 therein to a level such that the bottom frame member 15 of the section is located at a level above the bottom rail 19. The section 10 is thereupon lowered into the channel or track of the bottom rail 19 without leaving the track of the top rail 18. As can be seen in FIG. 3, the bottom rail 19, too, has a U-shaped cross-sectional outline and can comprise two mirror symmetrical portions 43 which flank the lowermost part of the bottom frame member 15 and extend along arcs of approximately 90°.

Each bottom frame member 15 includes an inverted U-shaped elongated envelope or shell for an elongated strip-shaped insert 20 which can be made of wood or any other suitable material. The arrangement may be such that the insert 20 is introduced into the track of the bottom rail 19 in a first step, that the top frame member 14 is thereupon inserted (from below) into the top rail 18 so that the envelope for the insert 20 is located above the upper side of the insert, and the section 10 is thereafter lowered so that the envelope of the bottom frame member 15 receives the major portion of the insert 20. When the insertion of a section 10 is completed, the section assumes a position corresponding to that of the section which is shown in FIG. 3.

The upper part of each top frame member 14 has a U-shaped cross-sectional outline, and the narrower lower part of each frame member 14 has an inverted U-shaped cross-sectional outline. The lower part defines a channel or groove 23 which receives the upper edge of the respective panel 11, and such upper edge is surrounded by an inverted U-shaped sealing element between the legs 22 of the lower part. Additional sealing elements 21 are interposed between the outer sides of the U-shaped upper part of the frame member 14 and the adjacent inner sides of the top rail 18.

The central portion of the horizontal web between the upper and lower parts of each top frame member 14 carries an elongated slotted tubular member 24 which can be used as a nut to receive the shank of a screw or bolt (not shown) serving to secure the top frame member 14 to the adjacent lateral frame member 12 or 13 or to the sidewall 40 or 41. As a rule, the screw which has a shank in the nut 24 is used to secure the top frame member 14 to the adjacent lateral frame member 12 or 13 in such a way that the respective end face of the frame member 14 abuts the adjacent vertical side of the frame member 12 or 13. For example, if a nut is to be used to connect the top frame member 14 of FIG. 3 to the lateral frame member 12 of FIG. 3, the shank of the screw or bolt in the nut 24 of the frame member 14 will extend in a direction from the observer toward the frame member 12 which latter has a tapped bore or hole for the shank.

In the partition which is shown in FIGS. 1 to 3, the width of each top frame member 14 equals or approximates the width of a lateral frame member 12 or 13 but exceeds the width of a bottom frame member 15.

The envelope of each bottom frame member 15 comprises a U-shaped upper part which is or can be a mirror image of the inverted U-shaped lower part of a top frame member 14, and an inverted U-shaped lower part which flanks the respective insert 20. The upper part of each bottom frame member 15 has two legs 22 which flank a U-shaped sealing element in a groove or channel 23 for the lower edge of the respective panel 11. The horizontal web between the upper and lower parts of the bottom frame member 15 has a slotted horizontal tube 12 which serves as a nut for the shank of a screw or bolt serving to separably affix the frame member 15 to the lateral frame member 12 or 13 or to the sidewall 40 or 41. The nut 24 of the bottom frame member 15 is adjacent the respective strip 20. Sealing elements 21 are interposed between the legs of the lower part of the frame member 15 and the respective sides of the insert 20. The sealing elements 21 can be dimensioned in such a way that they can be used between the top frame member 14 and the top rail 18 as well as between the lower part of the envelope of the bottom frame member 15 and the respective insert 20.

The lateral frame members 12 and 13 are or can be mirror images of each other and preferably constitute hollow profiled bodies (see FIG. 2) which have vertically extending external grooves 25 for the adjacent vertically extending edges of the respective panels 11. Each lateral frame member 12, 13 extends from the lower edge of the lower part of the envelope of a bottom frame member 15 to the upper edge of the upper part of a top frame member 14 (see FIG. 3). Such lateral frame members have a substantially rectangular or square cross-sectional outline. Those (outer) portions of the lateral frame members 12, 13 which are outwardly adjacent the respective vertical grooves 25 are narrower than the inner portions (such inner portions define the respective grooves 25) so that two adjacent frame members 12, 13 (i.e., the adjacent frame members 12, 13 of two neighboring sections 12) establish recesses 26 for the outer portions 34, 33 of male and female coupling member 28, 27 serving to separably connect neighboring sections 10 to each other. As can be seen in FIG. 2, the outer portions 34, 33 of the male and female coupling members 28, 27 can at least substantially fill the respective pairs of recesses in assembled condition of neighboring panels and need not extend beyond the corresponding (front and rear) sides of the coupling members.

Each female coupling member 27 has a female detent element 30 which extends into the relatively narrow clearance or gap 42 between the adjacent lateral frame members 12, 13 and defines a socket 32 serving to receive a bead or head 31 of the male detent element on the adjacent male coupling member 28, preferably by snap action. The head 31 is located at the free end of a web 29 which is integral with the exposed outer portion 34 of the male coupling member 28. The female detent element 30 and its socket 32 extend into the clearance 42 from one side and the male detent element 29, 31 extends into the clearance 42 from the other side of the partition which includes the sections 10 of FIG. 3. The outer portions 34, 33 of the male and female coupling members 28, 27 are located opposite each other at the respective sides of the clearance 42 and are at least substantially confined in the respective pairs of recesses 26.

The leftmost lateral frame member 13 of the partition which is shown in FIG. 1 is or can be separably affixed to the respective sidewall 40 by one or more screws or the like, not shown, and the rightmost lateral frame member 12 of such partition is separably screwed or otherwise affixed to the sidewall 41 of the room in which the partition is put to use. These lateral frame members are optional, i.e., the rightmost partition can abut the right-hand sidewall 41 and the leftmost partition 10 can abut the sidewall 40.

Each pair of neighboring sections 10 can be separably coupled to each other by two or more pairs of male and female coupling members 28 and 27. However, it is often preferred to utilize only one pair of coupling members 28, 27 each of which extends all the way between the top rail 18 and the bottom rail 19 in order to enhance the appearance of the assembled partition. Moreover, such elongated coupling members conceal the respective clearances 42 all the way between the top and bottom rails 18, 19 and thus reduce the likelihood of draft at both sides of the erected partition. Each coupling member has a substantially T-shaped cross-sectional outline. If desired, the configuration of outer portions 33, 34 of the female and male coupling members 27, 28 can be selected in such a way that they completely fill the respective pairs of recesses 26. The snap action between the sockets 32 of the female coupling members 27 and the heads 31 of male detent elements of the respective (aligned or confronting) male coupling members 28 is sufficiently pronounced to prevent accidental separation of the coupling members from each other and to exert a certain pressure against the adjacent lateral frame members 12, 13. However, the snap action is not so pronounced that it would be necessary to expel the outer portions 33, 34 from the respective pairs of recesses 26 in response to the exertion of a pronounced force.

An advantage of the improved partition is that it can be readily assembled or dismantled with little loss in time without any tools or by resorting to rudimentary tools. In addition, the number of sections 10 in the partition can be increased or reduced. Furthermore, one of the sections 10 which are shown in FIG. 1 can be omitted to thus establish a passage between the spaces at opposite sides of the partition. The passage can be shifted from the sidewall 40 toward the sidewall 41 or vice versa by the simple expedient of removing a selected section 10 and closing the existing passage with the thus removed section or with another section. The partition can be repaired by replacing one or more damaged or defaced sections with repaired, cleaned or new sections.

The sections 10 can be identical to reduce the manufacturing cost. However, it is equally within the purview of the invention to assemble one or more wider sections with one or more narrower sections, depending on the dimensions of the room in which the partition is to be put to use. A supply of modular sections 10 can be maintained in storage for erection of one or more additional partitions or to increase the length of one or more existing partitions.

The dimensions of all male and all female coupling members can be the same in order to reduce the cost of the partition and to ensure that a person who has learned to assemble two neighboring sections 10 into a partition can increase the length of such twin-section partition or assemble another partition because the mode of connecting a male coupling member 28 with a female coupling member 27 is always the same.

If the appearance of the assembled partition is thereby enhanced, the recesses 26 can be omitted and the outer portions 33, 34 of the coupling members 27, 28 can extend outwardly beyond the two sides of the assembled partition. Various color combinations can be resorted to in order to further enhance the appearance of an assembled partition.

The grooves 25 in the lateral frame members 12, 13 can be omitted if these frame members are provided with U-shaped extensions of the type shown in FIG. 3, as at 22. It is presently preferred to provide the lateral frame members 12, 13 with grooves 25 in order to enhance the appearance of the assembled frames and sections. Each lateral frame member can have a substantially semicircular cross-sectional outline.

The improved partition can be modified in a number of additional ways without departing from the spirit of the invention. For example, and as already mentioned above, the grooves 25 can be provided in extensions of those portions of the lateral frame members 12 and 13 which are adjacent the respective lateral edges of the panels 11. With reference to FIG. 3, each frame member 12, 13 can be provided with two legs 22 and with a sealing element in the channel 23 between such legs to receive the respective lateral edge of a panel 11 in the same way as shown for the top and bottom frame members 14, 15 and the respective top and bottom edges of the panel 11 in FIG. 3. Furthermore, the illustrated male and female detent elements 29, 31 and 30, 32 of FIG. 3 can be replaced with other types of detent elements; for example, the pairs of cooperating coupling members 27, 28 can be separably secured to each other by screws or bolts and nuts.

The panels 11 can be made of any suitable material such as wood, plastic, glass, metal or others. The frame members 12–15, too, can be made of any suitable material such as metal or plastic.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A room partition comprising at least two adjoining sections each including a panel having a top edge, a bottom edge and first and second lateral edges, top and bottom frame members respectively receiving the top and bottom edges, and first and second lateral frame members respectively receiving the first and second lateral edges, the first lateral frame member of one of said at least two sections being adjacent to and defining a clearance with the second lateral frame member of the other of said at least two sections; and means for separably coupling said adjacent lateral frame members, including at least one one-piece first coupling member overlying portions of said adjacent lateral frame members at one side of said clearance and at least one one-piece second coupling member overlying said adjacent lateral frame members at the other side of said clearance opposite said first coupling member, one of said coupling members having female detent means in said clearance and the other of said coupling members having male detent means engaging said female detent means.

2. The partition of claim 1, wherein each of said coupling members has a substantially T-shaped cross-sectional outline.

3. The partition of claim 2, wherein said male detent means includes a web extending into said clearance and having a bead, said female detent means including a socket which receives said bead with snap action.

4. The partition of claim 1, wherein at least a portion of each of said top and bottom frame members has a substantially U-shaped cross-sectional outline, and further comprising a floor-mounted rail which locates said bottom frame members in substantially horizontal positions and a ceiling-mounted rail which locates said top frame members in substantially horizontal positions.

5. The partition of claim 4, wherein said rails have tracks for portions of the respective frame members.

6. The partition of claim 1, wherein said top and bottom frame members have elongated channels for the top and bottom edges of the respective panels.

7. The partition of claim 6, wherein said top and bottom frame members have first and second ends which abut and are affixed to the first and second lateral frame members of the respective sections.

8. The partition of claim 1, wherein each of said first and second lateral frame members is hollow and has a polygonal outline.

9. The partition of claim 1, wherein each of said lateral frame members has a groove for the respective edge of the corresponding panel.

10. A room partition comprising at least two adjoining sections each including a panel having a top edge, a bottom edge and first and second lateral edges, top and bottom frame members respectively receiving the top and bottom edges, and first and second lateral frame members respectively receiving the first and second lateral edges, the first lateral frame member of one of said at least two sections being adjacent to and defining a clearance with the second lateral frame member of the other of said at least two sections, said adjacent lateral frame members having recessed at both sides of said clearance; and means for separably coupling said adjacent lateral frame members, including at least one first coupling member overlying portions of said adjacent lateral frame members at one side of said clearance and at least one second coupling member overlying said adjacent lateral frame members at the other side of said clearance opposite said first coupling member, one of said coupling members having female detent means in said clearance and the other of said coupling members having male detent means engaging said female detent means, said coupling members having portions in said recesses.

11. The partition of claim 10, wherein said portions of said coupling members at least substantially fill the respective recesses.

* * * * *